United States Patent [19]

Franzen

[11] 4,241,765

[45] Dec. 30, 1980

[54] SHUTTLE DRIVE ARRANGEMENT

[76] Inventor: Gert E. A. Franzén, Pionvägen 3, S-610 40 Gusum, Sweden

[21] Appl. No.: 8,418

[22] Filed: Feb. 1, 1979

[30] Foreign Application Priority Data

Feb. 8, 1978 [SE] Sweden ..... 7801457

[51] Int. Cl.[2] ..... D03D 49/28

[52] U.S. Cl. ..... 139/142; 139/155

[58] Field of Search ..... 139/133, 142, 143, 155, 139/437, 438, 439, 449

[56] References Cited

U.S. PATENT DOCUMENTS

| | | | |
|---|---|---|---|
| 1,945,996 | 2/1964 | Rossmann | 139/142 |
| 2,976,892 | 3/1961 | Morin | 139/437 |

FOREIGN PATENT DOCUMENTS

| | | | |
|---|---|---|---|
| 454675 | 1/1926 | Fed. Rep. of Germany | 139/142 |
| 446219 | 3/1968 | Switzerland | 139/142 |
| 1080571 | 8/1967 | United Kingdom | 139/437 |

*Primary Examiner*—Henry Jaudon

*Attorney, Agent, or Firm*—Kinzer, Plyer, Dorn & McEachran

[57] ABSTRACT

A shuttle-drive arrangement for a weaving loom comprises at least one drive rotor (1) having a helical driving means (5) arranged to co-act with a shuttle-dogging device (23) for driving a shuttle (14) across the loom. The rotor (1) is arranged to be continuously rotated by a drive source (7). And means (8,9,10) are arranged to indicate the rotary position of the rotor and the driving means. When the driving means is located in a given position for driving the shuttle, a coupling mechanism (20,24,23) is arranged to be activated to an operative state for coupling the dogging device (23) to the driving means (5).

7 Claims, 6 Drawing Figures

1
2
3
4
5
6
7
8
9
10
11
12
14
15
16
17
18
19
20
21
22
23
24
26
27
37
43
44
45
A

SHUTTLE DRIVE ARRANGEMENT

The present invention relates to a shuttle drive arrangement for a weaving loom, said drive arrangement comprising a drive rotor having a helical driving means arranged to co-operate with a shuttle-dogging device for driving a shuttle across the loom.

One disadvantage with known arrangements of this type is that the drive rotor is held stationary between shuttle movements and thus must be accelerated when the shuttle is picked or cast. The energy which is consumed when effecting this acceleration and the requisite mass increase expotentially with the speed and hence the requisite high initial velocity of the shuttle is never reached, even though very large drive motors may be used. It is also difficult to provide a well defined engagement between the driving means and the dogging device on the shuttle.

Thus a primary object of the invention is to provide a drive arrangement which is very compact and which, when the shuttle is cast or picked, imparts thereto the requisite energy from its own kinetic energy.

A further object of the invention is to provide a drive arrangement which provides a well defined and positive engagement when the shuttle is cast or picked, whereby the initial velocity of the shuttle can be held within given, narrow limits and the speed of the shuttle can be increased in comparison with shuttle speeds hitherto known, thereby enabling the capacity of the loom to be increased.

Another object of the invention is to provide a drive arrangement which, despite the fact that the shuttle moves more quickly than said shuttles of conventional looms, requires a relatively low energy supply, i.e. can be driven with a relatively small motor. As a result hereof, the drive arrangement as a whole may be formed as a compact unit which can be made moveable to and readily adapted to different weaving widths in a loom and to impart a high-speed to the shuttle, while, at the same time, keeping disturbing noise at a low level.

These objects are fully realized by means of the invention as defined in the claims and described hereinafter with reference to an exemplary embodiment thereof illustrated in the accompanying drawings.

Figure 1:
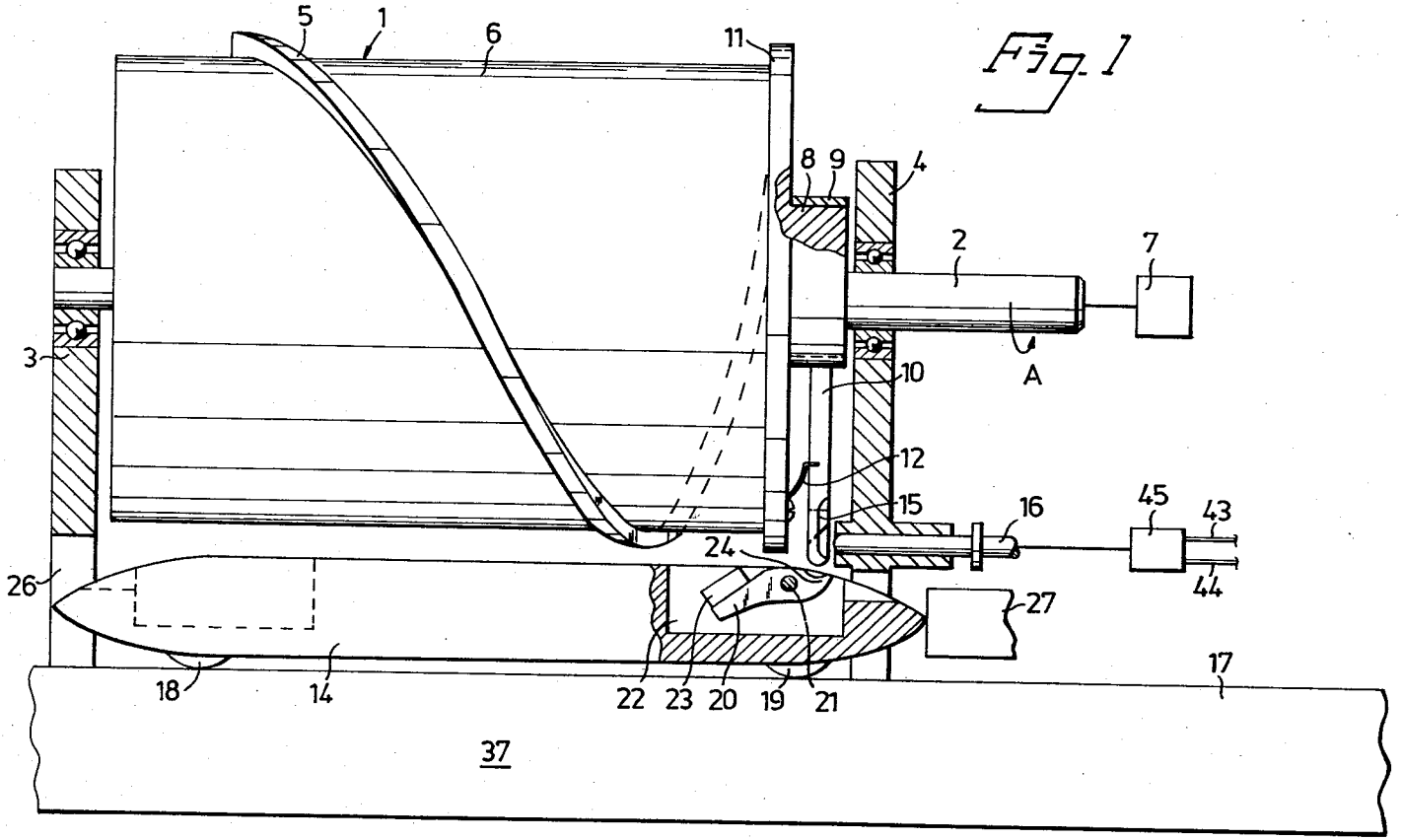
FIG. 1 illustrates a shuttle drive arrangement according to the invention, and a shuttle associated with said arrangement.
Figure 2:
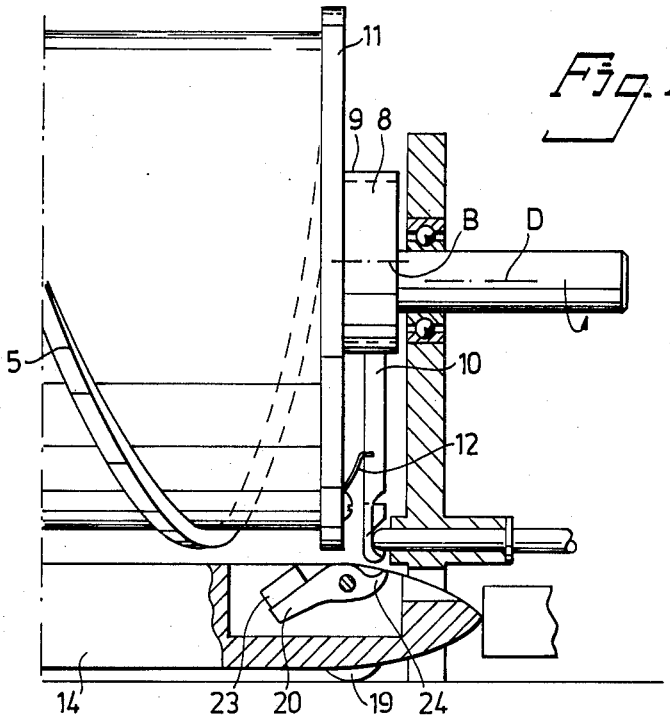
FIG. 2 illustrates a shuttle drive arrangement in a first phase of releasing the shuttle.

In FIGS. 1–4 there is illustrated a cylindrical rotor 1 having a centrally arranged shaft 2 which is journalled for free rotation in frame walls 3,4. In the illustrated embodiment, the rotor 1 is provided on its cylindrical surface with a helical cam 5. The cam 5 may be replaced, for example, with a guide groove milled in the surface 6. The rotor 1 has a high mass and is continuously driven by an electric motor 7 which is connected directly to the shaft 2 and thus drives the rotor, without interruption, in one and the same direction, as indicated by means of the arrow A in FIG. 4. An eccentric 8 forms part of the rotor 1. The eccentric 8 is cylindrical and has a center of rotation B which lies at a distance C from the center of rotation D of the rotor 1. A ring 9 is arranged for free rotation on the cylindrical surface of the eccentric 8. The ring 9 carries a radially extending impact arm 10.

A holding spring 12 is fixed to a wall 11 of the rotor 1 by means of a screw 13. The purpose of spring 12 is to hold the impact arm 10 in the position shown in FIG. 4 when the shuttle 14 is not to be released. Thus, when the impact arm 10 is held by the spring 12, the ring 9 is held stationary relative to the eccentric 8 and the impact arm 10 will slide in its longitudinal direction on the spring 12, between an inner position and an outer position depending on the position of the center B relative to the centre D.

A shoulder 15 on the lower end of the impact arm 10 is arranged to co-operate with a piston 16. The piston 16 is displacably mounted in the frame wall 4 and can be moved between an inoperative position (FIGS. 1 and 3) and an operative position (FIG. 2) displaced inwardly towards the rotor 1, in which position the inner end of the piston 16 lies in the path of movement of the impact arm 10.

Figure 5:
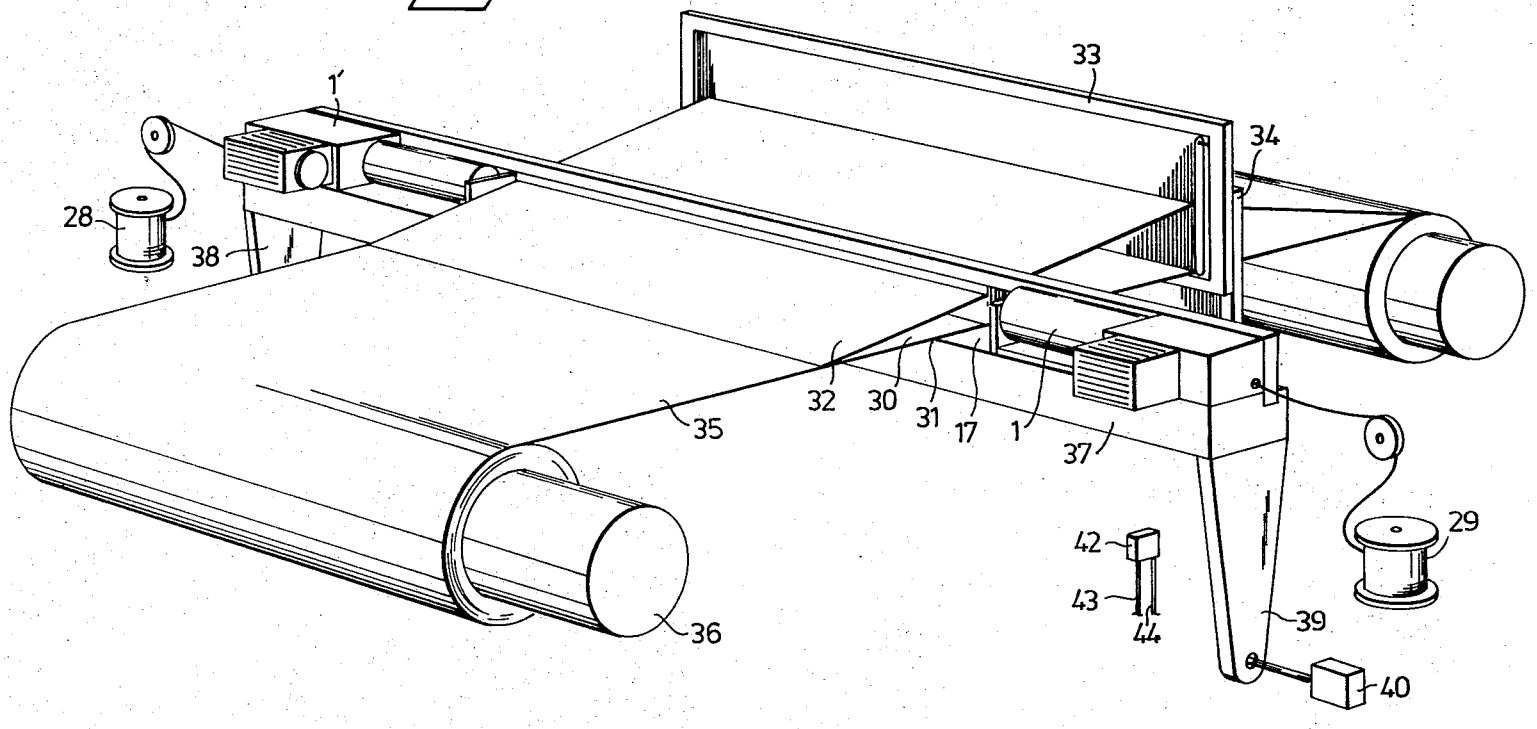
FIG. 5 is a simplified view of the drive arrangement according to the invention installed in a loom.

The shuttle 14, which is moved on a track or guide surface 17, has, in the illustrated embodiment, two pairs of wheels 18 and 19, although the shuttle may also slide directly on the track 17. Arranged on both ends of the shuttle is a drive mechanism adapted to co-operate with the cam 5 on the rotor 1. The right-hand rotor 1 of the loom is shown in FIG. 1. FIG. 5 illustrates both the left-hand rotor, here referenced 1', and the right-hand rotor 1 for driving the shuttle 14 across the loom illustrated in FIG. 5. The drive mechanism for driving the shuttle 14 to the left as seen in FIG. 5 is shown in detail in FIG. 1, while the corresponding drive mechanism for driving the shuttle 14 to the right as seen in FIG. 5 is indicated in FIG. 1 in phantom lines.

Figure 3:
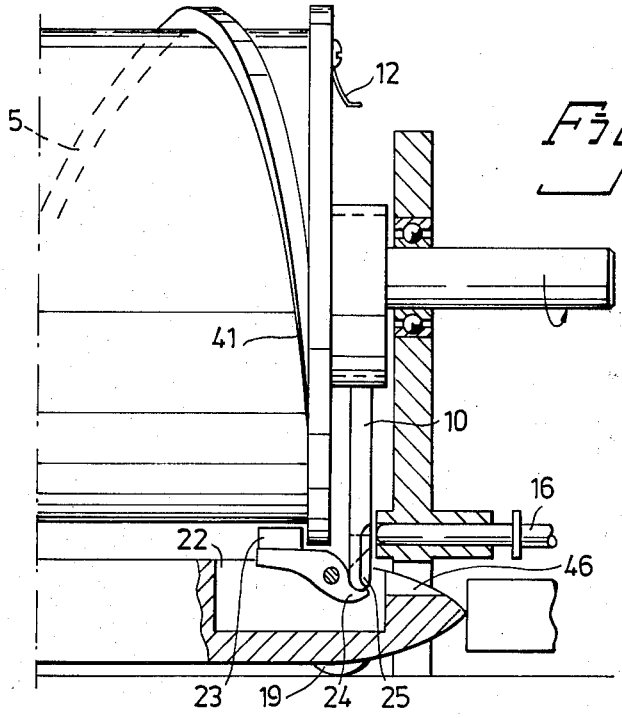
FIG. 3 illustrates a subsequent phase in releasing said shuttle.
Figure 4:
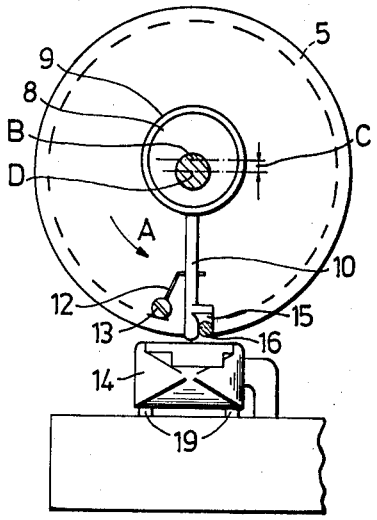
FIG. 4 illustrates the drive arrangement shown in FIG. 1, seen to the right end of said figure and having certain parts removed for the sake of clarity, said figure showing the same release phases as those illustrated in FIGS. 1 and 2.

Each drive mechanism for the shuttle 14 comprises a pivot arm 20 mounted on a pivot shaft 21 which is journalled between two walls which extend at right angles to the horizontal track 17, in a recess 22 in the right end of a shuttle 14 as shown in FIG. 1. A corresponding recess is provided in the left end of the shuttle 14 in FIG. 1. The pivot arm 20 carries on the end thereof directed towards the central part of the shuttle 14, a cam follower 23 which is arranged to co-act with the cam 5. The outer end of the pivot arm 20 has an impact surface 24 arranged to co-operate with the free-end 25 of the impact arm 10, as illustrated in FIG. 3. As will be seen from FIG. 1, there is provided in the frame wall 3 an opening 26 through which the shuttle 14 can be moved to the left part of the loom in FIG. 5. The outer end of a shuttle 14 rests against a shuttle-capturing and -damping body 27 which slows down the shuttle during its movement, to the position illustrated in FIG. 1. In FIG. 5 there is illustrated by means of two spools 28,29 those yarns which are caught by the shuttle and drawn through the shed 30 between parts 31 and 32. In FIG. 5 there are illustrated two conventional heald frames 33 and 34 which provide the alternation of sheds when moved up and down. The arrangements whereby the shuttle 14 seizes the yarns are of conventional construction and are not illustrated here. The woven cloth 35 is wound onto a roller 36, as shown in FIG. 5. In the illustrated embodiment, the track 17 is arranged on the batten 37 of the loom, said batten carrying the drive mechanisms 1 and 1'. The batten 37 is mounted on arms 38 and 39 driven by means of a conventional beater or picker 40, as indicated in FIG. 5.

One of the primary objects of the invention is to be able to cast the shuttle 14 through the shed 30 rapidly, thereby to obtain a high production rate, compared with conventional weaving looms, while, at the same time, keeping the power applied to the shuttle-drive arrangement continuous and relatively low. To this end, the diameter, length and mass of the rotor 1 are selected so that the resultant inertia is sufficient to generate enough kinetic energy to accelerate the shuttle to the desired final velocity for a given pitch of the guide cam 5, at a given rotary speed. By way of example, it can be mentioned that with a desired initial velocity of approximately 20 M/s and a shuttle weight of 1 kg and a power input from the motor 7 of 0,25 kW, there is used, for example, a rotor having the following characteristics:

| | |
|---|---|
| Mass | 20 kg |
| Diameter | 100 mm |
| Length | 370 mm |
| Rotary speed | 2800 r/min |
| Cam | exponential pitch and comprising 350 mm of the rotor length |

The pitch of the cam 5, or of the corresponding groove in the rotor 1, is caused to increase towards the outlet end, i.e. towards the left end of the rotor 1 as seen in FIG. 1, thereby to obtain a favourable acceleration path of the shuttle at a given rotary speed. With a shuttle having the aforementioned parameters, it is possible to obtain in the case of a narrow loom, a working period of approximately 2 seconds, i.e. the time between two picks from one and the same end of the loom is approximately 2 seconds. Of this time period, approximately 0.035 seconds is taken up by the picks, i.e. the transfer of kinetic energy from the rotor 1 to the shuttle 14 and the remaining time is used for supplying the kinetic energy used for driving the shuttle, from the motor 7 to the rotor 1. The power input of the motor 7 of the rotor 1 is substantially smaller than the power required to drive-off the shuttle 14 with the desired final velocity.

In order for the shuttle to be driven-off, it is necessary that the rotor 1 is located at an angular position such that the cam follower 23 is caught by the cam 5 at its end point and lies against the driving side 41 of the cam 5 (FIG. 3). This angular position is obtained automatically by the position of the impact arm 10 relative to the rotor 1 when said arm is held by the spring 12. Further, it is necessary for the shed 30 to be open to receive the shuttle 14 and the weft carried by said shuttle. In the illustrated embodiment, the receiving position of the shed 30 is determined by sensing the position of the batten arm 39 by means of a schematically illustrated detector 42. When the detector 42 determines the position of the arm 39, a circuit is made to an electromagnetic operating device 45 over lines 43,44 (FIG. 1). When the device 45 is activated, the piston 16 is displaced inwardly from the inoperative position shown in FIG. 1 to the operative position shown in FIG. 2, where the piston lies in the path of movement of the impact arm 10.

When the impact arm 10, which is held in a given position relative to the cam 5 during rotation of the rotor 1, meets the end of the inwardly moved piston 16, the arm 10 engages the end of the piston 16 and movement of the arm 10 together with the rotor 1 is interrupted. The eccentric 8 is then located in the position shown in FIG. 4. During continued rotation of the rotor 1, the eccentric will move the ring 9, and therewith the arm 10 downwardly from the position shown in FIG. 4 to the position shown in FIG. 3. The piston 16 is moved by the shoulder 15 back to the inoperative position, when the arm 10 pushes up the cam follower 23, as illustrated in FIG. 3. In this latter position, the end of the arm 10 will urge the impact surface 24 clockwise in FIG. 3 and therwith lift the cam-follower roller 23 up over the shuttle 14 and place it before the cam 5. As the rotor 1 continues to rotate, the cam 5 will urge the cam-follower roller 23 to the left in FIG. 3 and the end of the arm 10 will slide out of the shuttle 14 through a groove 46 which opens into the recess 22 in the shuttle 14. During the period of engagement between the cam follower 23 and the cam 5, for example a period of 0.035 seconds, the shuttle 14 will be accelerated to the desired speed and moved on wheels 18,19 across the batten 37 to the arrangement 1' in FIG. 5, in which the left end of the shuttle as seen in FIG. 1 is caught by the damping device corresponding to the device 27 in FIG. 1. As soon as the piston 16 has been moved back, the spring 12 will pick up and carry the arm 10, which is thus brought into engagement for a following sequence of the cam follower 23.

The aforedescribed shuttle caster can be modified in many ways. For example, the release piston 16 can be mounted in the shuttle and, for example, moved up into the movement path of the arm 10 electromagnetically. In order to hold the arm in a releasable, given position during rotation of the rotor 1, there can be arranged on the rotor a permanent magnet which holds the arm fixed, said arm in this case being made of a magnetisable material. The magnetic force generated will not be greater than that required to readily stop the arm 10 by the piston 16. It is also possible to arrange for the two rotors to be rotated by one and the same drive motor.

In the aforegoing the invention has been described with reference to a weaving loom in which each time the shuttle moves across the loom, a yarn is moved into the shed 30. The invention can be applied equally as well, however, to those types of looms in which the shuttle moves in a closed path from one starting position through the shed formed by the healds and back to said starting point without passing through the shed.

It will be understood that the drive means can also be used in respect of conventional shuttles provided with yarn spools. It is also possible to mount the shuttle-dogging device 23 co-acting with the cam 5 on a separate carriage 47 or the like (FIG. 6) said carriage being arranged to transfer movement to the shuttle. Thus, this would imply that the whole mechanism 20-24 (FIG. 5) is mounted on a carriage or runner arranged to move on a guide 50 or the like parallel with the shuttle 14 and to firmly grip the shuttle with a shoulder 48 or the like arranged on the carriage, which shoulder in turn grips behind a shoulder 59 or an abutment surface on the shuttle.

Figure 6:
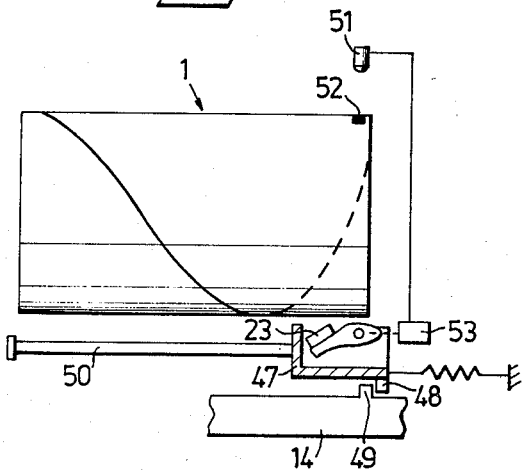
FIG. 6 is a simplified view of a modified embodiment.

The illustrated mechanical release mechanism having an impact arm 10 which defines the position of the rotor and therewith the position of the cam 5 has only been selected by way of example. For example there can equally as well be arranged a conventional electronic sensing means, for example a photo-cell 51 (FIG. 6)

arranged to sense a position-indicating mark 52 on the rotor and, when sensing said mark, to send an activating signal to an electromagnet 53, which brings the dogging device 23 into engagement with the cam surface 41.

In certain cases it may be convenient for the rotor to have the form of a disc, i.e. a cylindrical body whose diameter is large in relation to its axial length, and to arrange the drive cam 5 or the drive groove on one surface of the disc. Such an embodiment is particularly suited for older, very narrow looms.

In certain cases it may also be convenient to arrange two mutually counter-rotating rotors, thereby to counteract those tangential forces which occur. In this case, the drive path or tracks on respective rotors co-act with the shuttle either directly or via a carriage or runner.

I claim:

1. A shuttle-drive arrangement for a weaving loom, comprising at least one drive rotor (1) having a helical driving means (5) arranged to co-act with a shuttle-dogging device (23) for driving a shuttle (14) across the loom, characterized in that the rotor (1) is arranged to be continuously rotated by a drive source (7); that means (8,9,10; 51,52) are arranged to indicate the rotary position of the rotor and the driving means; and that when the driving means is located in a given position for driving the shuttle, a coupling mechanism (20,24; 23,53) is arranged to be activated to an operative state for coupling the dogging device (23) to the driving means (5).

2. An arrangement according to claim 1, characterized in that said driving means comprise an electric sensing device (51) arranged to sense a marking (52) on the rotor (1) in a manner such that when said mark is located in a given position an electro-magnetic coupling means (53) is activated to cause the dogging device to engage the drive track (5).

3. A shuttle drive arrangement according to claim 1, characterized in that said driving means comprise a cylindrical eccentric body (8) fixedly connected to the rotor (1), the axis of rotation (B) of said body being displaced relative to, but parallel with the rotary axis (D) of the rotor; that the eccentric body is arranged to move an impact arm (10) between a first, inoperative position and a second operative position, in which second position the impact arm activates the coupling mechanism.

4. An arrangement according to claim 3, characterized in that the arm (10) is fixedly mounted on a ring (9) which is freely slidable on the cylindrical surface of the eccentric body (8); that the rotor (1) is provided with a yieldable holding means (12) adapted to hold the arm in a given angular position relative to the driving means (5); and that a stop means (16) is arranged to be moved into the path of movement of the said arm in the direction of rotation of the rotor and to hold the same for activation of the coupling mechanism.

5. An arrangement and shuttle according to claim 4, characterized in that the stop means comprise a piston (16) which can be moved to said movement path of said arm (10) and which is coupled to an activating means (45) arranged to be activated in dependence upon a signal in forming that the shuttle can be moved across the loom and, therewith, to move the piston into said movement path.

6. An arrangement and shuttle according to claim 1, characterized in that the rotor (1) comprises a cylinder and that the driving means is a helical cam (5) on the cylindrical surface of the cylinder (1).

7. An arrangement according to claim 1 characterized in that the mass of rotor (1) is considerably greater than the mass of the shuttle (14); and that the power supplied to the rotor from said drive source (7) is considerably smaller than the power required to accelerate the shuttle (14) to the desired final velocity.

* * * * *